US005581249A

United States Patent [19]

Yoshida

[11] Patent Number: 5,581,249

[45] Date of Patent: Dec. 3, 1996

[54] MOBILE COMMUNICATION SYSTEM

[75] Inventor: Ichiro Yoshida, Takahama, Japan

[73] Assignee: Nippondenso Co., Ltd, Kariya, Japan

[21] Appl. No.: 601,682

[22] Filed: Feb. 15, 1996

[30] Foreign Application Priority Data

Feb. 17, 1995 [JP] Japan ..... 7-029615

[51] Int. Cl.[6] ..... G80G 1/00; G80G 1/065

[52] U.S. Cl. ..... 340/928; 340/933; 340/937; 235/384; 235/492

[58] Field of Search ..... 340/928, 933, 340/937, 911, 905, 936; 235/380, 382, 384, 492, 437; 464/456, 464.01

[56] References Cited

U.S. PATENT DOCUMENTS

| | | | |
|---|---|---|---|
| 5,101,200 | 3/1992 | Swett | 340/928 |
| 5,144,553 | 9/1992 | Hassett et al. | 340/928 |
| 5,212,373 | 5/1993 | Fujioka et al. | 235/492 |
| 5,378,887 | 1/1995 | Kobayashi | 235/492 |
| 5,406,275 | 4/1995 | Hassett et al. | 340/928 |

FOREIGN PATENT DOCUMENTS

| | | | |
|---|---|---|---|
| 2-112721 | 4/1990 | Japan | G01C 21/00 |
| 4-315282 | 11/1992 | Japan | G07B 15/00 |
| 6-131590 | 5/1994 | Japan | G08G 1/017 |

*Primary Examiner*—Jeffery Hofsass
*Assistant Examiner*—Van T. Trieu
*Attorney, Agent, or Firm*—Cushman, Darby & Cushman

[57] ABSTRACT

A mobile communication system for highway toll charging and the like includes road-side units which periodically poll vehicle-mounted units. When traffic near a road-side unit is slow, repeated polling of a given vehicle-mounted unit that has not moved out of the road-side unit's communicable area may result in erroneous double charging of a toll. It is possible to set a fixed delay in the vehicle-mounted unit to avoid this; in this case, however, a toll may erroneously not be charged if the vehicle passes through the same or another road-side unit within the delay period. To solve this problem, the road-side unit calculates a response delay having a length appropriate to avoid the above-described effects based on the speed of vehicles passing it and transmits the response delay to the vehicle-mounted units.

7 Claims, 8 Drawing Sheets

PREDET. AREA DET. SIG.
OUT
IN

CPU OP.
RUN
SLEEP
TOLL CHG. PROC.

TIMER
ON
OFF
COMM. STOP TIME
VEHICLE SIDE

PILOT SIG.

DATA COMM.
TOLL CHG. PROC.
t1
t2
t3
t4
t6
ROAD SIDE

PREDET. AREA DET. SIG.
OUT
IN
NOISE

CPU OP.
RUN
SLEEP
TOLL CHG. PROC.

TIMER
ON
OFF
COMM. STOP TIME
VEHICLE SIDE

PILOT SIG.

DATA COMM.
TOLL CHG. PROC.
t11
t14
TOLL CHG. PROC.
ROAD SIDE

PREDET. AREA DET. SIG.
OUT
IN

CPU OP.
RUN
SLEEP
TOLL CHG. PROC.

TIMER
ON
OFF
COMM. STOP TIME
VEHICLE SIDE

PILOT SIG.

DATA COMM.
TOLL CHG. PROC.
t21
t22
t23
t24
ROAD SIDE

PREDET. AREA DET. SIG.
OUT
IN

CPU OP.
RUN
SLEEP
TOLL CHG. PROC.

TIMER
ON
OFF
COMM. STOP TIME
VEHICLE SIDE

PILOT SIG.

DATA COMM.
TOLL CHG. PROC.
t31
t32
ROAD SIDE

MOBILE COMMUNICATION SYSTEM

CROSS-REFERENCE TO RELATED APPLICATION

This application is related to and claims priority from Japanese Patent Application No. Hei-7-29615, the contents of which are hereby incorporated by reference.

BACKGROUND OF THE INVENTION

1. Field of the Invention

The present invention relates to a mobile communication roadside device, a mobile communication moving body-mounted device and a mobile communication system for sending a predetermined signal to a predetermined area along a movement route and performing predetermined communication with a moving body that responds to the predetermined signal as in, for example, a toll charging process of a highway tollgate using non-contact IC cards or the like.

2. Description of Related Art

In recent years, for vehicular toll road toll charging systems, the settling of toll charges without stopping the vehicle through the use of a non-contact IC card has been considered.

For example, as a system which executes toll charging on a vehicle that is cruising along a toll road, when communicating with a vehicle-mounted device having a communication function and an IC card read-write function (hereinafter referred to as a vehicle-mounted device) and a communicator provided at a toll gate (hereinafter referred to as a roadside device), one proposed system (Japanese Patent Laid-Open Application Hei-4-315282) performs toll charging by setting a communication sequence with a plurality of vehicles. In this system, when performing communication with a particular vehicle, sending of inquiry numbers to other vehicles inside a communicable area is suspended so that there will be no jamming of the communication. However, in this system, even after once finishing the toll charging process, when the same vehicle has not left the communicable area because of traffic or the like, there have been cases when communication is performed again and repeated toll charging is executed.

As a system for preventing repeated toll charging, one proposed system (Japanese Patent Laid-Open Application Hei-6-131590) prohibits signal receipt for a predetermined period of time at the vehicular side after once performing communication.

However, in this system, because a predetermined properly-set signal receipt prohibition time is always used, in case of heavy traffic, there might be cases when a vehicle has not left a communicable area even after the predetermined signal receipt prohibition time has elapsed. For such cases, toll charging is performed again. Moreover, on the other hand, if a long predetermined signal receipt prohibition time is set in consideration of heavy traffic, the vehicle might pass through the next toll gate (including the same toll gate when returning back) within such predetermined signal receipt prohibition time when there is no traffic and so, there is a possibility that toll charging will not be performed at the next toll gate.

SUMMARY OF THE INVENTION

In view of the foregoing problems of the prior art in mind, it is a goal of the present invention to prevent repeated communication when the mobile body is in the same area and the state wherein no communication is performed even though the vehicle has entered a different area or has returned again to the same area when returning back.

To achieve this goal, one aspect of the present invention provides a mobile communication system which has a mobile communication roadside device for sending a predetermined signal to a predetermined area along a movement route, as well as for performing a predetermined communication with a mobile communication moving body-mounted device which responds to said predetermined signal, wherein the mobile communication roadside device includes a movement condition detection unit for detecting a movement condition along the movement route, a communication stoppage time setting unit for setting communication stoppage time in accordance with movement condition detected by the movement condition detection unit, and a communication stoppage time sending unit for sending communication stoppage time set by the communication stoppage time setting unit after including communication stoppage time data in the predetermined signal or in the predetermined communication.

In this way, under movement conditions where the moving body is moving fast, by shortening the communication stoppage time, the communication stoppage time setting unit can prevent the mobile communication moving-body mounted device, which has been set with the communication stoppage time after receiving this communication stoppage time, from leaving a predetermined area and entering a different predetermined area or the same predetermined area by returning back without performing the necessary communication (for example, toll charge processing at toll roads).

Also, under movement conditions where the moving body is not moving fast, by extending the communication stoppage time, such circumstances where the same communication is performed again on the mobile communication moving body-mounted device side, which has been set with the communication stoppage time after receiving such communication stoppage time, in the same predetermined area while such moving body-mounted device has not left the predetermined area even once is prevented, and there will be no resulting inconvenience of executing repeated communication.

Another aspect of the present invention provides a mobile communication system in which the movement condition detection unit detects movement speed of a moving body along the movement route or data which corresponds to movement speed as the movement condition, and the communication stoppage time setting unit shortens the communication stoppage time when movement speed is fast and extends the communication stoppage time when movement speed is slow in accordance with movement condition detected by the movement condition detection unit.

The movement condition detection unit may detect as the movement condition the movement speed of the moving body along said movement route or data which corresponds to the movement speed. In accordance with the movement condition detected by the movement condition detection unit, the communication stoppage time setting unit may shorten the communication stoppage time with faster movement speed and extend the communication stoppage time with slower movement speed.

In other words, since the time from entering the predetermined area up to the leaving the predetermined area is inversely proportional to the movement speed of the moving body, the faster the movement speed of the moving body is, the lesser the probability of repeated toll charging becomes even if the communication stoppage time is shorter. In addition, because the time of movement from one predetermined area to another predetermined area (including the case of returning to the same predetermined area) is inversely proportional to the movement speed of the moving body, the lower the movement speed of the moving body is, the lesser the possibility of leaving the next predetermined area entered without communicating even if the communication stoppage time is set longer.

A further aspect of the present invention is that the moving body is an automobile and the predetermined communication is a toll charging process.

In this way, there will be no repeated toll charging in the same predetermined area nor will there be a non-execution of the toll charging process even after entering a different predetermined area or even after returning back again to the same predetermined area.

An additional aspect of the present invention provides a mobile communication system wherein the mobile communication moving body-mounted device includes a communication prohibition unit for prohibiting another communication with the mobile communication roadside device during a communication stoppage time after performing the predetermined communication based on communication stoppage time data included in the predetermined signal or the predetermined communication.

In this way, this mobile communication moving body-mounted device can properly adjust the communication stoppage time in accordance with received communication stoppage time data. Therefore, in accordance with the movement condition, when data in which the communication stoppage time is shortened when movement is fast and extended when movement is not fast is sent from the mobile communication roadside device, by shortening the communication stoppage time under movement conditions wherein the moving body is moving fast, departure from the predetermined area and entrance to a different predetermined area or return to the same predetermined area without performing the necessary communication can be prevented.

Also, by extending the communication stoppage time under movement conditions where the moving body is not moving fast, the case where the same communication is performed again despite the fact that the mobile communication moving body-mounted device itself continues to remain in the same predetermined area is prevented and thus, there will be no resulting inconvenience of having repeated communication (for example, where a toll is repeatedly charged).

A yet further aspect of the present invention is a mobile communication system wherein the mobile communication moving body-mounted device further includes an area determination unit for giving a within predetermined area decision when the predetermined signal is received and for giving an outside predetermined area decision when the predetermined signal is not received, and a communication permission unit for permitting the predetermined communication when moving from outside of the predetermined area to inside of the predetermined area based on the decision of the area determination unit, and the communication prohibition unit has not prohibited another communication.

In this way, the mobile communication moving body-mounted device may commence predetermined communication with the mobile communication roadside device. Based on this, predetermined communication can be performed properly without repetition in the next predetermined area (including the case when the vehicle returns to the same predetermined area).

Another aspect of the present invention provides a mobile communication system wherein the mobile communication moving-body mounted device further includes an area storage unit for storing the predetermined area that has been passed previously, wherein the communication permission unit permits the predetermined communication even if the communication prohibition unit prohibits another communication if the present predetermined area is different from the previous predetermined area stored by the area storage unit when moving from outside of the predetermined area to inside of the predetermined area based on the decision of the area determination unit.

In this way, even during the communication prohibition time, if moving to a different predetermined area, it can be determined that there is certainly a need to execute the predetermined communication because there will be no repetition of the predetermined communication in the same predetermined area.

A yet further aspect of the present invention provides a mobile communication system wherein the predetermined communication is executed through a CPU computation process, and the communication prohibition unit prohibits another communication by making the CPU enter a sleep state. In this way, electric power consumption can be reduced drastically.

BRIEF DESCRIPTION OF THE DRAWINGS

Additional objects and advantages of the present invention will be more readily apparent from the following detailed description of preferred embodiments thereof when taken together with the accompanying drawings in which:

FIG. 2A is an explanatory drawing of a predetermined area where a pilot signal is generated and FIG. 2B is a graph showing contents of the pilot signal;

FIG. 5A is a flowchart of toll charging and the like in the roadside device and FIG. 5B is a flowchart of a movement condition detection process in the embodiment;

DETAILED DESCRIPTION OF PRESENTLY PREFERRED EXEMPLARY EMBODIMENTS

Preferred embodiments of the present invention are described hereinafter with reference to the accompanying drawings.

Figure 1:
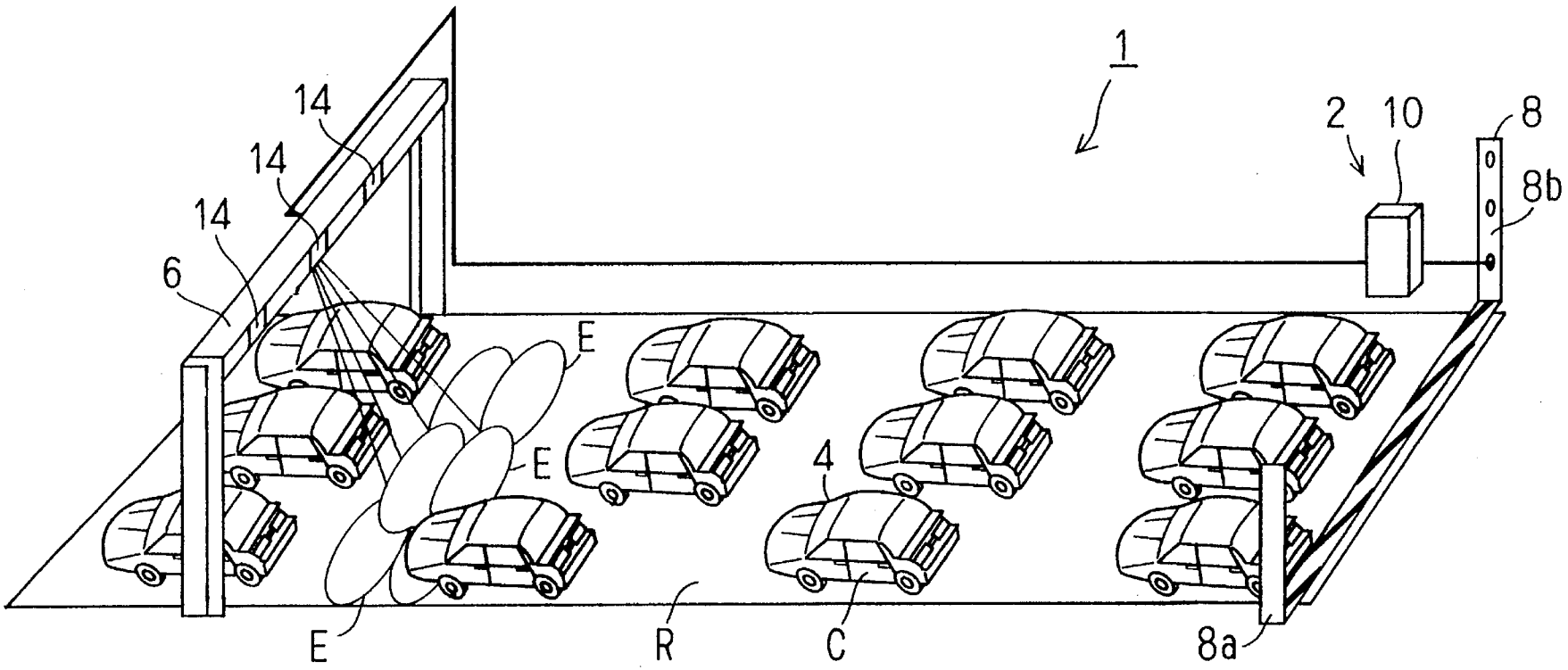
FIG. 1 is a schematic block diagram of a mobile communication system according to a preferred embodiment of the present invention.
Figure 3:
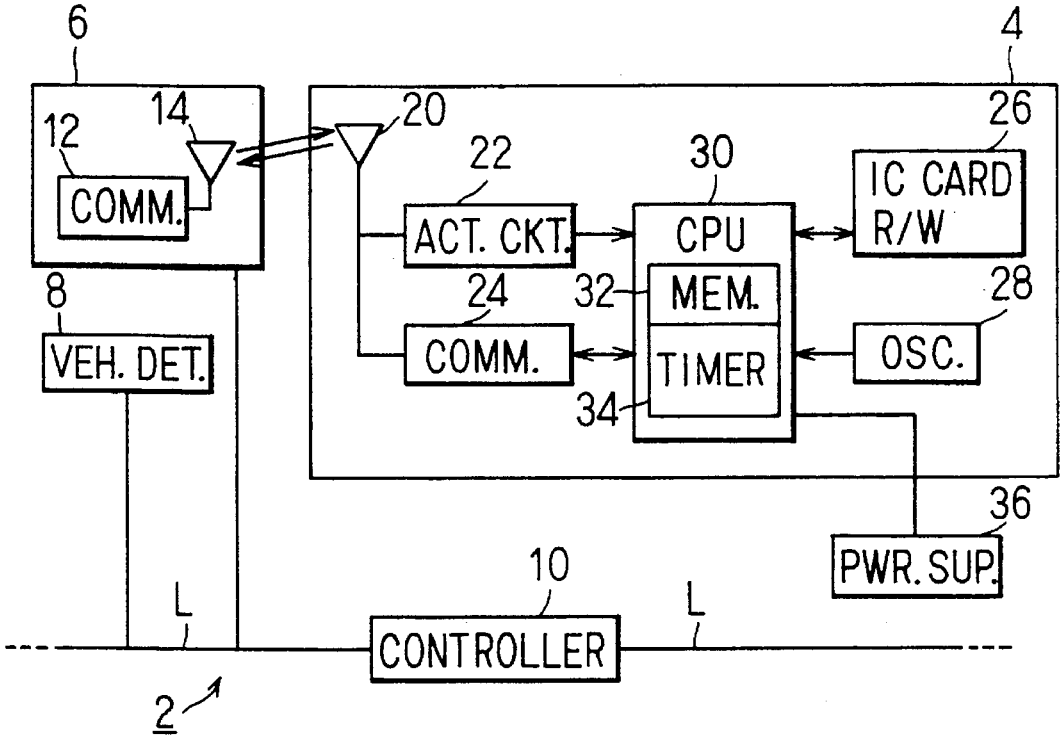
FIG. 3 is a block diagram of the mobile communication system according to the embodiment.

FIG. 1 shows a mobile communication system 1 which includes a roadside device 2 and a vehicle-mounted device 4. The roadside device 2 includes a gantry 6, a vehicular detector 8 and a controller 10. The gantry 6 is built over a road R and, as shown in FIG. 3, is provided with an internal communication circuit 12 and an internal antenna 14. The communication circuit 12 generates a communication signal and a pilot signal from the controller 10 as radio wave signals via the antenna 14, and, in addition, receives a radio wave communication signal from the vehicle-mounted device 4 side mounted inside a vehicle C. The vehicle detector 8 includes a light beam generator 8*a* and a light beam detector 8*b* which are provided on opposite sides of the road R and detects if the light beam is blocked by the vehicle C or not.

Figure 2A:
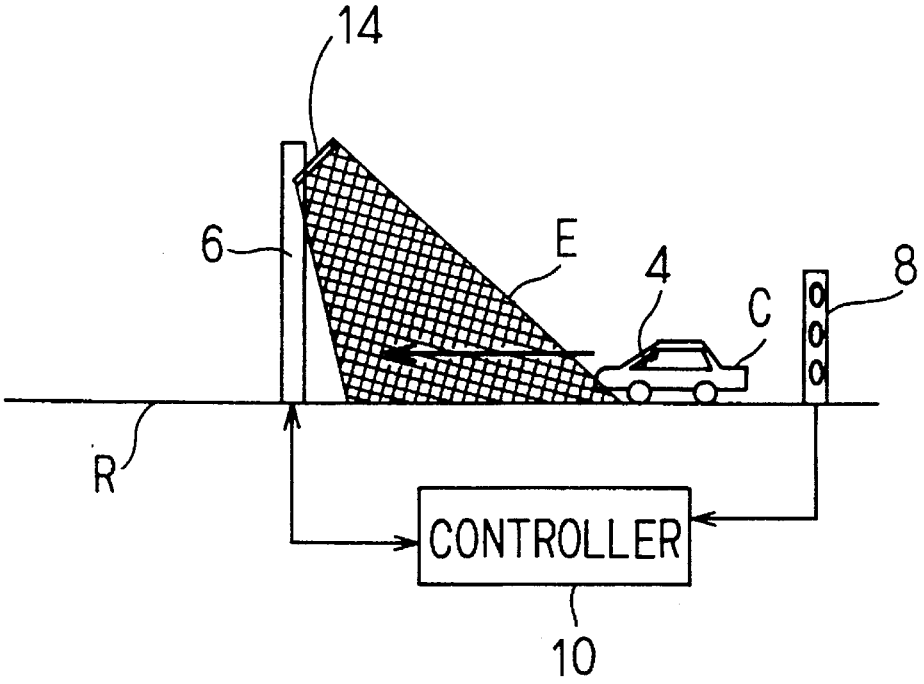
FIGS. 2A and 2B are explanatory diagrams of signal outputs of a roadside device where

The pilot signal from the antenna 14, as shown in FIGS. 1 and 2A, is generated only over a predetermined area E. Therefore, the vehicle-mounted device 4 can receive the pilot signal from the roadside device 2 and verify that the vehicle C has entered the predetermined area E only when the vehicle C has entered the predetermined area E.

Figure 2B:
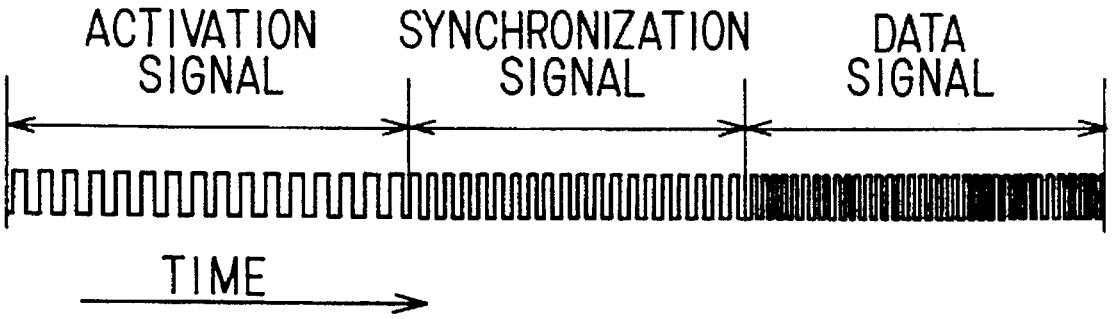

The pilot signal, as shown in the timing chart of FIG. 2B, includes an activation signal, a synchronization signal and a data signal. During generation of the pilot signal, the controller 10 repeatedly transmits the signal shown in FIG. 2B according to a predetermined cycle from the antenna 14. Also, if a response signal is received when the vehicle-mounted device 4 responds to the pilot signal, the controller 10 performs a predetermined communication procedure, in other words, the toll charging procedure. It must be noted here that the data signal of the pilot signal includes a roadside device ID (identification number) for identifying the gantry 6 and communication stoppage time data which is explained later.

It must be noted here that, as shown in FIG. 3, the controller 10 which is connected to a remote control center via a signal line L sends data of toll charge results and the like, and receives necessary control signals from the control center.

The vehicle-mounted device 4 includes an antenna 20, an activation circuit 22, a communication circuit 24, an IC card reader-writer 26, an oscillating element 28, and a central processing unit (hereinafter referred to as CPU) 30. It must be noted here that the CPU 30 has an internal memory 32 and an internal timer 34. In addition, a battery-based electric power supply circuit 36 is connected to the vehicle-mounted device 4.

Figures 4A, 4B, 4C, 4D, 4E, 4F, 4G, 4H, 4I, 4J:
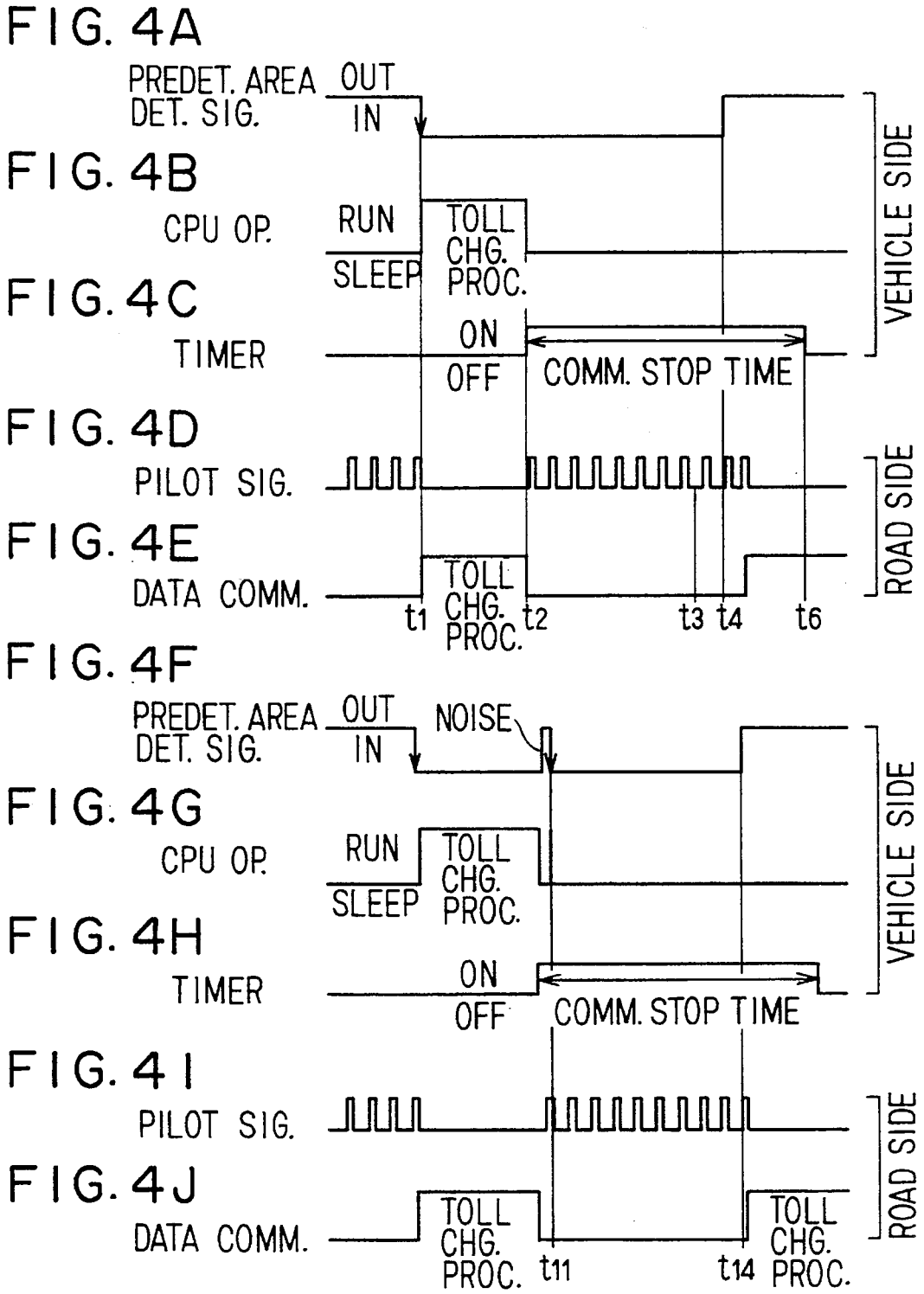
FIG. 4A–4J are graphs of signals generated by a process executed between the roadside device and the vehicle-mounted device in the embodiment.

Through the antenna 20, the activation circuit 22 makes a predetermined area detection signal fall as shown in FIG. 4A when the pilot signal from the antenna 14 of the gantry 6 is received to show that it realized that it is within the predetermined area. At that timing, the CPU 30 transits from a sleep state to a run state. The sleep state refers to the condition wherein the states of registers, pointers and the like of the CPU 30 are retained while suspending operations. The run state refers to the condition wherein a predetermined process is being actually executed following a program stored inside the memory 32 in accordance with a clock pulse of the oscillating element 28. Therefore, with the fall of the predetermined area detection signal generated by the activation circuit 22, the CPU 30 which is in a sleep state is activated and processing can be continued from the state immediately preceding the sleep state. It must be noted here that while the CPU 30 might be in a sleep state, the internal timer 34 is still functioning and so, there is no stop in the timer count.

Also, the activation circuit 22 extracts a particular frequency component (the component of the activation signal) from within the pilot signal, stores it in a capacitor and makes the terminal voltage of the capacitor the predetermined area detection signal. Therefore, as shown in FIGS. 4A, 4D, 4F and 4I, while the pilot signal which is being generated at a predetermined cycle is still being received continuously, the predetermined area detection signal is continuously generated at a level which indicates an inside of the predetermined area. On the contrary, if the pilot signal is no longer received, as shown in the timing of t4, t14 of FIGS. 4A, 4D, 4F and 4I, the predetermined area detection signal rises and is continuously generated at a level which indicates the vehicle is outside of the predetermined area.

The communication circuit 24 generates the presence/absence of the pilot signal from the roadside device 2 and the data signal within the pilot signal to the CPU 30, generates a response signal to the roadside device 2 based on the process of CPU 30, and executes a communication process with the roadside device 2 to charge a toll.

The IC card reader-writer 26 is a device for writing on the inserted IC card in order to charge the toll or for reading the contents of the IC card in order to send personal information from the IC card to the roadside device 2. The oscillating element 28 generates a clock signal to the CPU 30 for driving the same, and through gate circuits and the like, the CPU 30 can make itself enter a sleep state by, e.g., stopping the input of the clock signal, and can return to the run state and continue operations in accordance with an external signal.

Next, among the processes executed in the controller 10, the process performed with the vehicle-mounted device 4 is explained.

Figure 5A:
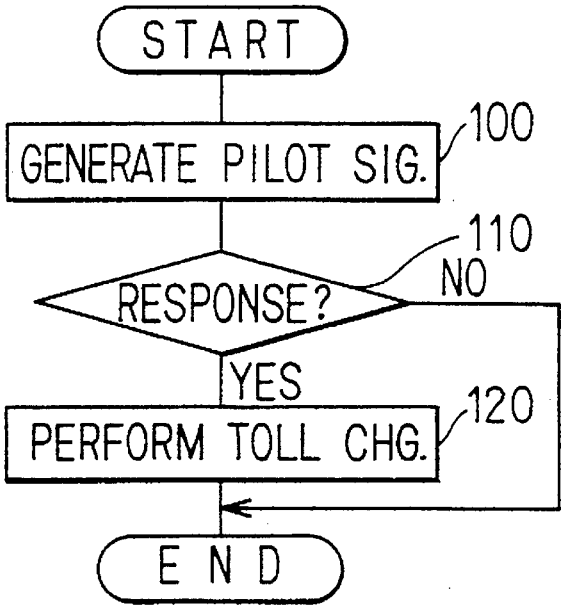
FIGS. 5A and 5B are flowcharts showing the processing of the roadside device where

FIG. 5A shows a flowchart of the process. This process is repeatedly executed at a predetermined cycle.

When processing starts, first, step 100 generates the pilot signal shown in FIG. 2B. Next, step 110 determines if there is a response to this pilot signal. In case there is no response, a negative decision is given and processing ends for this time, and after the predetermined cycle, processing is repeated again from the process of step 100.

In case there is a response, step 110 gives a positive decision and step 120 executes the toll charging process is execute.

This process is shown in the timing chart of FIGS. 6A–6E. Because no response signal is received from the vehicle-mounted device 4 before time t1, positive decisions will not be given by step 110 and while the pilot signal is generated by step 100 at the predetermined cycle, because there is a response from the vehicle-mounted device 4 at time t1, the toll charging process is executed and processing finishes at time t2.

Figure 5B:
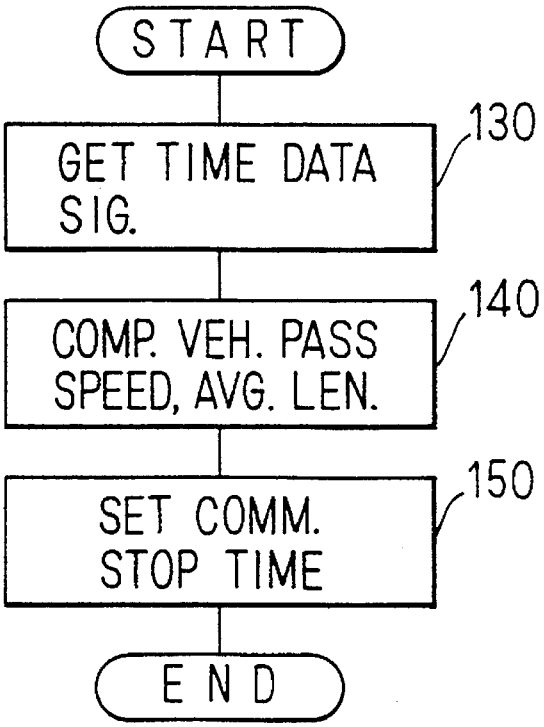

Also, the controller 10 executes the process shown in FIG. 5B during the interruption process activated by the signal from the vehicular detector 8. The signal from the vehicular detector 8 is a signal which includes, for example, data on the time the light beam from the light beam generator 8*a* is blocked as detected by the light beam detector 8*b* (in other words, the time of passage for one vehicle), data of the vehicular count per predetermined period of time and the like. When processing starts, first, step 130 enters the time data signal, and next, step 140 computes the vehicular passing speed based on this time data and the vehicular average length set beforehand.

Next, based on this cruising speed, step 150 sets the communication stoppage time. The details of this setting procedure will be explained.

First, from the data detected by the vehicular detector 8 and from the computation of step 140, the passing speed is set as v (m/sec).

Setting the length of the predetermined area E in the cruising direction as Le(m), the time Tx(sec) for the vehicle C to pass the predetermined area E is computed as in the following Eq. 1.

$$Tx=Le/v \quad (1)$$

Figure 6:
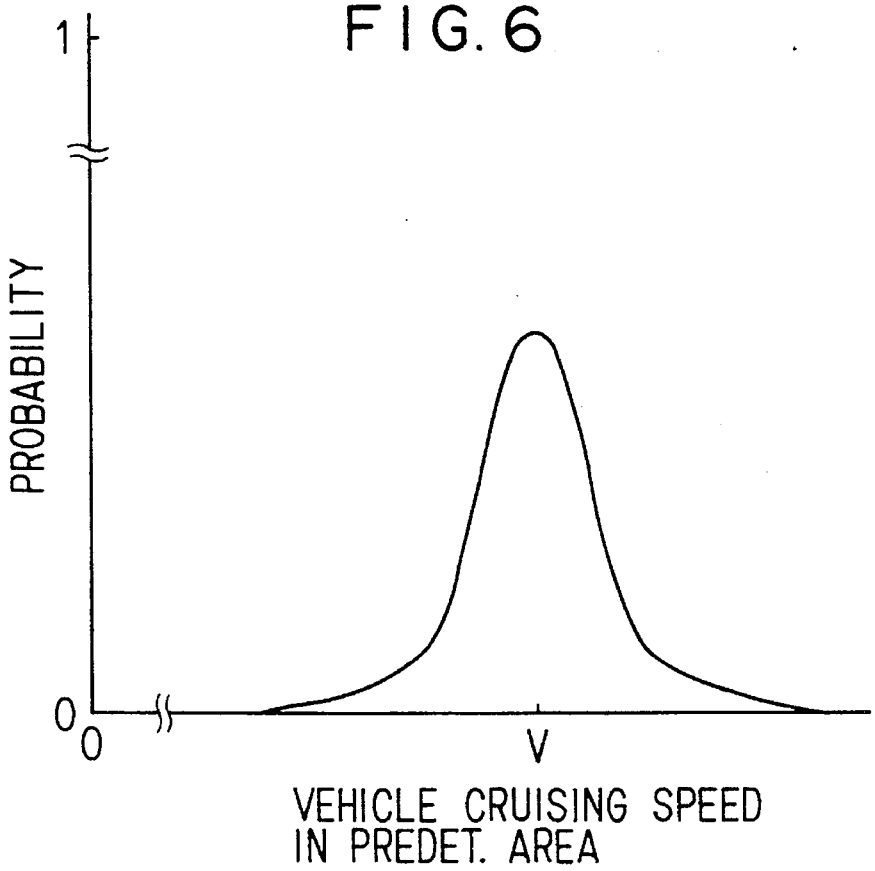
FIG. 6 is a graph showing a distribution of vehicle cruising speeds through a predetermined toll charging area.

However, even if the vehicle C passed by the vehicle detector 8 at the passing speed v, it does not necessarily follow that it will continue to run at the passing speed v upon entering the predetermined area E afterwards. For example, cruising conditions might differ in a short period of time after passing by the vehicle detector 8 or there might be traffic due to an accident. According to the observations of the inventor, the cruising speed in the predetermined area E of the vehicle C which passed by the vehicle detector 8 at the passing speed v will actually, as shown in FIG. 6, have a bell curve-shaped distribution with the passing speed v at its center. As clearly shown in FIG. 6, the cruising speed in the predetermined area E of the vehicle C which passed by the vehicle detector 8 at the passing speed v changes in accordance with the distribution of FIG. 6 with the highest probability that the vehicle C will cruise at the passing speed v. Therefore, the passing time Tx of the vehicle C in the predetermined area E also changes following the change in the cruising speed of the vehicle C in the predetermined area E (the degree of variation of time Tx is referred to as temporal variation f).

This temporal variation f is defined in Equation 2.

$$f=Ts/Tx \quad (2)$$

where Ts is the communication stoppage time, as will be discussed in greater detail below.

It must be noted here that according to experiments conducted by the inventor,.the lower the passing speed v is, the larger temporal variation f becomes.

Figure 7:
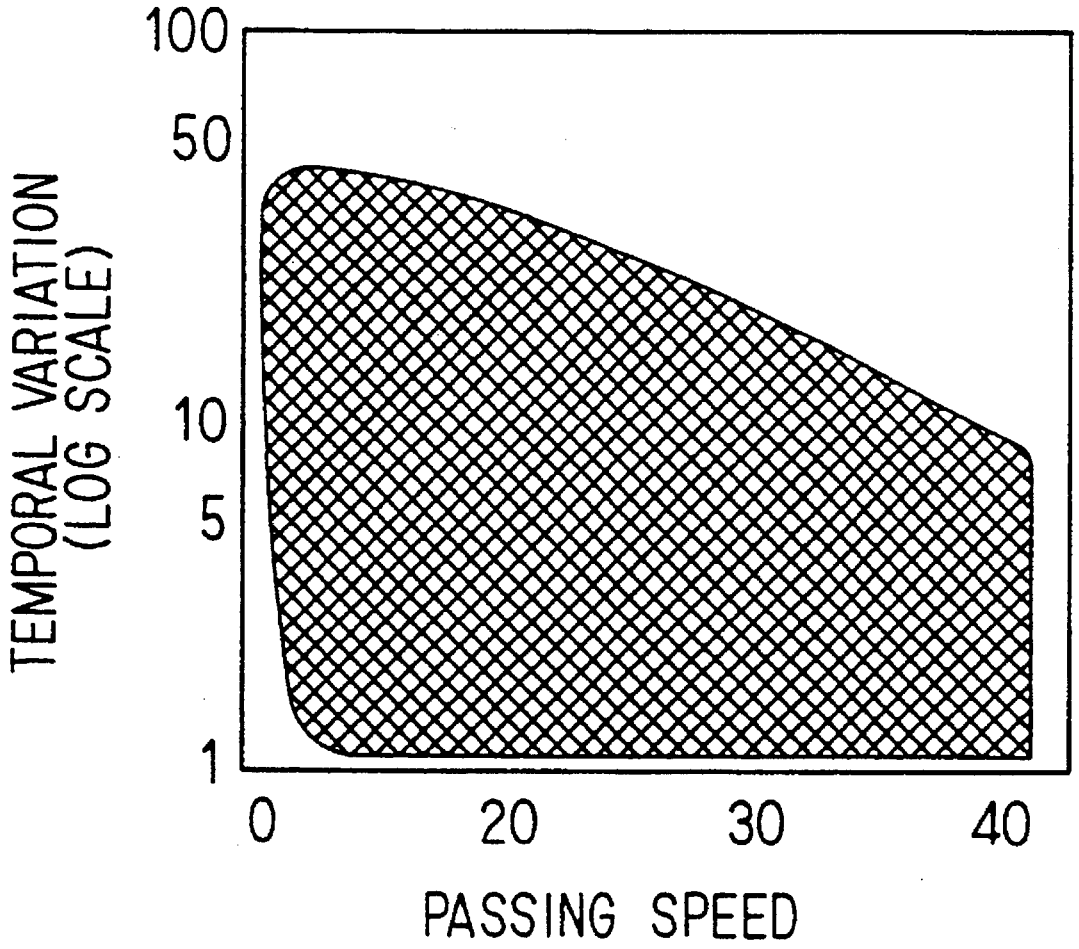
FIG. 7 is a graph showing the relationship between passing speed and time variation.

Here, one example of the relationship between the passing vehicle speed v and the temporal variation f is shown in FIG. 7. It is clear from FIG. 7 that even if the passing speed v is constant, time Tx changes with the temporal variation f. In practice, the optimal temporal variation f is set based on various road conditions (accidents, traffic, road surface conditions and the like) and on weather, climate and the like.

Here, if Ts is the value set for the communication stoppage time, Ts will be considered in reference to the temporal variation f; in other words, Ts is computed as the product of the temporal variation f and time Tx.

For example, if the passage speed v during traffic=1 m/sec (3.6 km/hr) and the length Le of the predetermined area E=3 m, then passage time is computed using Eq. 3.

$$Tx=3\ (m)/1\ (m/sec)=3\ (sec) \quad (3)$$

Multiplying temporal variation f (from the graph of FIG. 7, f is set to 40) by this, then communication stoppage time Ts is computed as in Equation 4.

$$Ts=3\ (sec)\times 40=120\ (sec) \quad (4)$$

In this way, the computed communication stoppage time Ts which is included together with the ID of the roadside device 2 and other data in the data signal shown in FIG. 2B which is within the pilot signal is transmitted.

Figure 8:
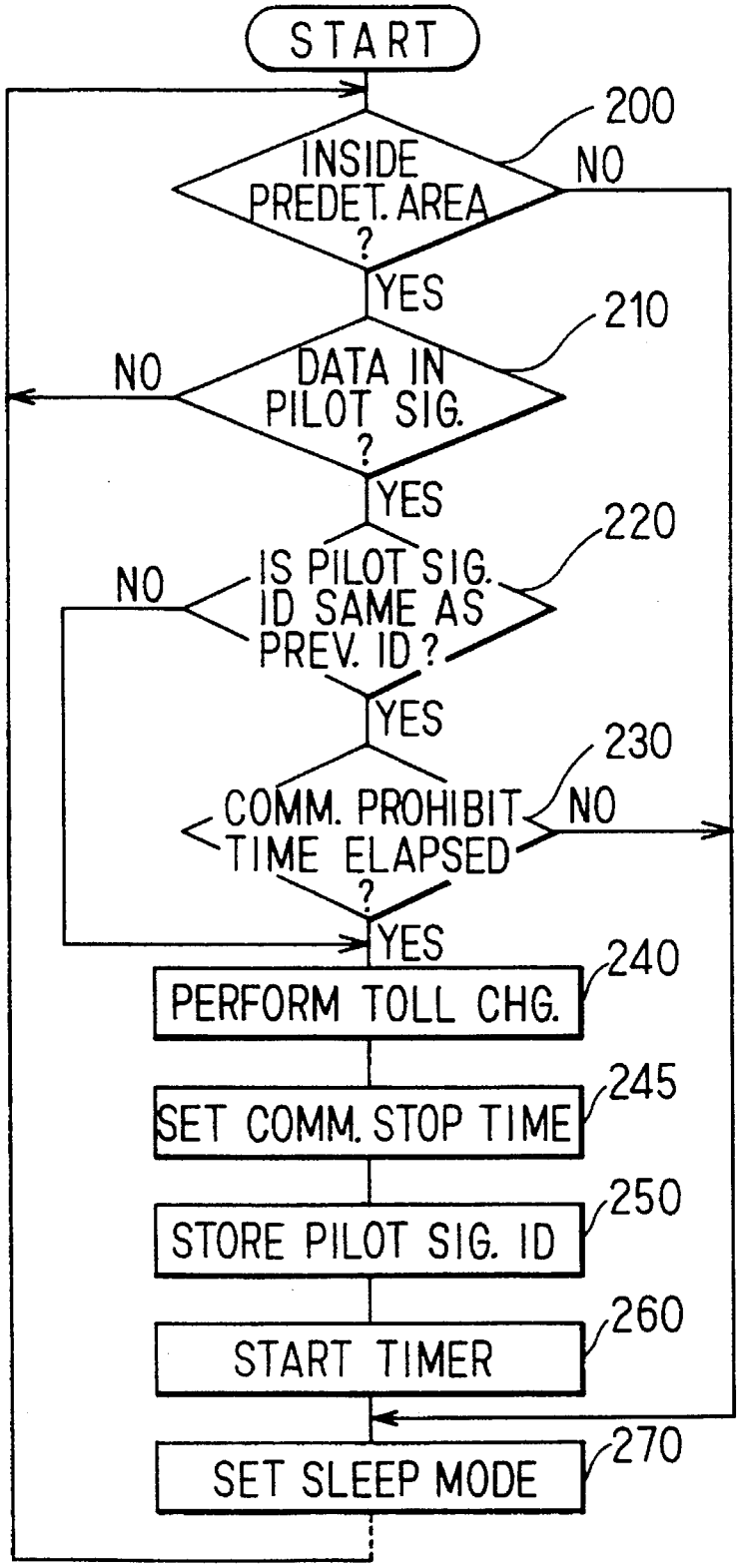
FIG. 8 is a flowchart showing the process of the vehicle-mounted device in the embodiment.
Figures 9A, 9B, 9C, 9D, 9E, 9F, 9G, 9H, 9I, 9J:
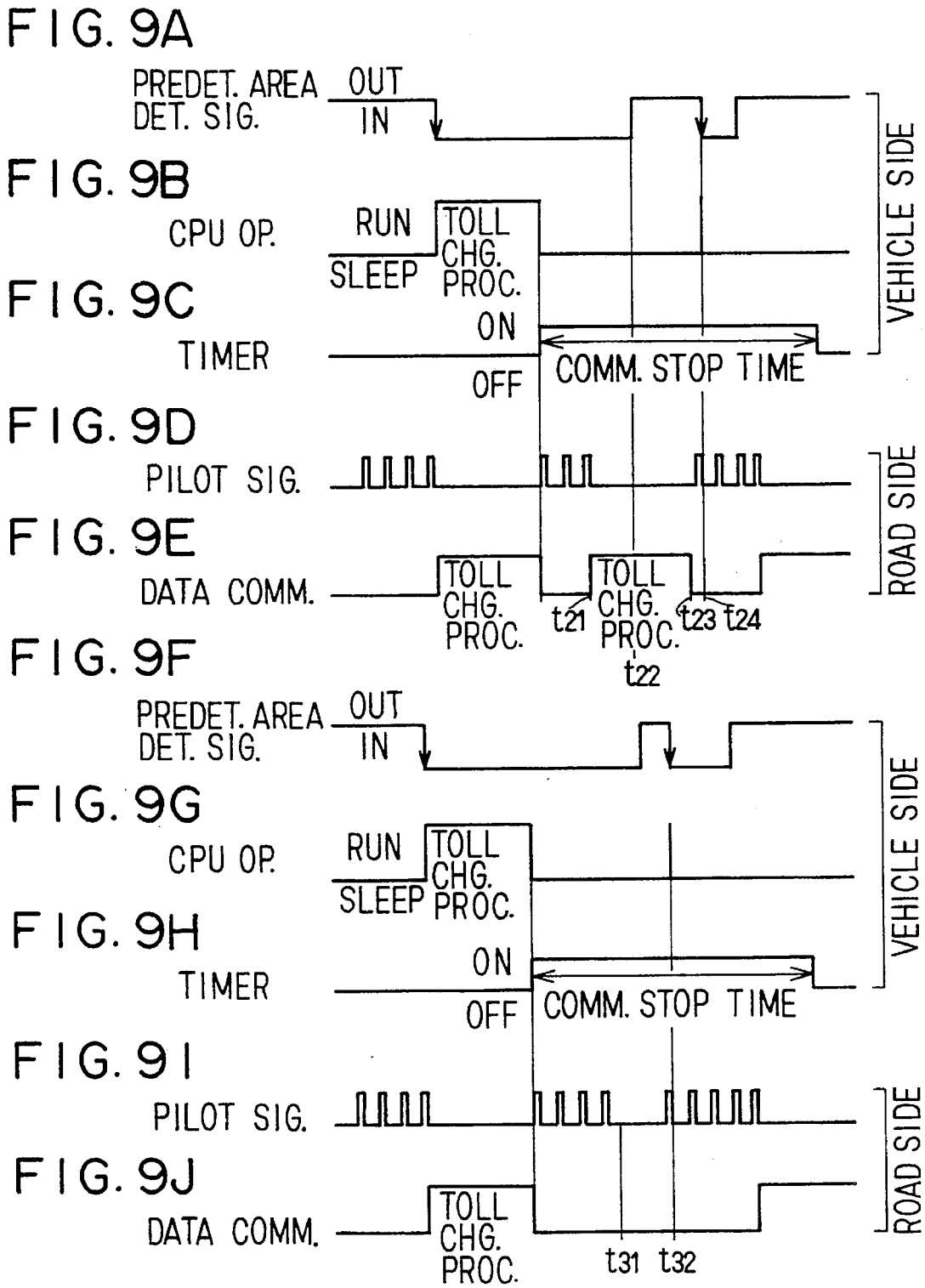
FIGS. 9A–9J are graphs of signals generated by a process executed between the roadside device and the vehicle-mounted device in the embodiment.

Next, the operation of the CPU 30 of the vehicle-mounted device 4 is explained using the flowchart of FIG. 8.

First, when processing commences, step 200 determines if it is inside the predetermined area E or not. This is for determining whether or not the communication circuit 24 has received the pilot signal from the vehicle-mounted device 4 via the antenna 20, and when: 1) the pilot signal shown in FIG. 2B has not actually been received; and/or 2) the predetermined area detection signal generated by the activation circuit 22 indicates the vehicle is outside of the predetermined area, step 200 gives a negative output and step 270 sets the sleep mode. When the sleep mode is set, the clock signal from the oscillating element 28 is cut-off and the operations of the CPU 30 terminate while retaining the contents of the register, pointer and the like. However, the internal timer 34 continues to operate independently even if the CPU 30 is in the sleep state.

The state before time t1 in FIGS. 4A–4E is the sleep state. Therefore, after step 270, the process of FIG. 8 terminates at this state. Based on the pilot signal from the roadside device 2, unless the activation circuit 22 makes the predetermined area detection signal fall or unless processes such as resetting or the like are performed, the sleep state of the CPU 30 continues.

When the vehicle C enters the predetermined area E and receives the pilot signal from the roadside device 2, in accordance with the activation signal shown in FIG. 2B which has a predetermined frequency and which is transmitted at the predetermined period, first, the activation circuit 22 operates and makes the predetermined area detection signal fall from indicating the outside of the predetermined area to indicating the inside of the predetermined area. From the timing of this fall, the CPU 30 which has suspended operations during the sleep state resumes operation. In other words, operation starts from the process of step 200 immediately following step 270.

In step 200, as discussed before, even if within the predetermined area E, if the received signal is judged to be noise or the like and not the pilot signal during judging based on the data received by the communication circuit 24, step 200 gives a negative output and sleep mode is set and so, CPU 30 enters the sleep state.

If the received signal is not noise or the like and step 200 gives a positive output, next, to check the pilot signal, step 210 determines if there is data included in the contents of the pilot signal. In other words, judging is performed on whether or not data which corresponds to the data signal shown in FIG. 2B is contained in the data entered from the communication circuit 24.

If there is no data contained, step 200 checks again if the pilot signal has been received or not.

If the pilot signal contains data and the process of step 210 gives a positive decision, then step 220 determines if the ID of the roadside device 2 stored previously is the same as the roadside device 2 ID contained inside the data signal of the present pilot signal or not. If this ID is different, it is clear that the vehicle has entered the inside of the predetermined area E of a different roadside device 2, and so, step 220 gives a negative output and step 240 executes the toll charging process. In other words, when performing the communication procedure with the roadside device 2 side to charge toll, a predetermined toll demanded by the roadside device 2 side is additionally charged to the IC card inserted in the IC card reader-writer 26.

Next, step 245 sets the communication stoppage time, which is already contained in the data signal inside the pilot signal received from the communication circuit 24 and which is for preventing double toll charging, to the internal timer 34.

Next, step 250 sets the ID of the present roadside device 2 already contained in the data signal inside the pilot signal received from the communication circuit 24 in memory 32.

Then, step 260 starts the internal timer 34, step 270 sets the sleep mode and so, the CPU 30 enters a sleep state. It must be noted here that as discussed above, the internal timer 34 continues to count on its own even if the sleep mode is set. This timing corresponds to time t2 of FIGS. 4A–4E.

Hereinafter, the vehicle deserts the predetermined area E at time t2 and so, it will not be able to receive any pilot signals and at time t4, the predetermined area detection signal changes from indicating inside the predetermined area to indicating outside the predetermined area.

Therefore, from time t2 to time t3, while the vehicle-mounted device 4 is inside the predetermined area E where the pilot signal can be received, the predetermined area detection signal is kept at the inside the predetermined area state and from this, because the CPU 30 is kept at a sleep state, the toll charging procedure of the step 240 is not performed repeatedly within the same predetermined area E. Furthermore, after the toll charging procedure, because the CPU 30 enters the sleep state, as opposed to the case when the CPU 30 is simply not performing the toll charging procedure, the electric power consumption of the CPU 30 becomes very small. For example, it is reduced to 1/1000 of its active consumption. This prolongs battery life when a battery is used as the electric power source circuit 36.

Also, as shown in FIG. 4F–4I, within the same predetermined area E, after the toll charging process, when the predetermined area detection signal of the activation circuit 22 indicates the outside area due to noise while the vehicle C has not yet left the predetermined area E, the predetermined area detection signal falls down in accordance with the receipt of the next pilot signal (time t11). During this time, CPU 30 resumes operations, step 200 gives a positive output, step 210 also gives a positive output and because the previous ID and the ID contained in the present pilot signal are the same, step 220 gives a positive output. Next, while referring to internal timer 34 which has been set with the communication prohibition time in previous step 245, step 230 determines if the communication prohibition time has elapsed or not. While the vehicle C has not yet left the same predetermined area E, if the process of FIG. 8 resumes due to noise, step 230 gives a negative output because the internal timer 34 has not yet completed counting the communication prohibition time, and immediately, step 270 sets the sleep mode.

Therefore, if process of FIG. 5 resumes due to noise while the vehicle C has not yet left the same predetermined area E, because the communication prohibition time has not yet elapsed since the end of the toll charging procedure, the CPU 30 again returns to the sleep state and the toll charging process is not executed. Therefore, repeated toll charging is not executed even if there is noise.

Also, because the CPU 30 immediately enters the sleep state even if there is noise, low power consumption is maintained.

As shown in FIGS. 9A–9E, while the vehicle C has not yet left the predetermined area E, because the roadside device 2 has commenced a toll charging procedure with another vehicle C (time t21) and not because of noise, there are cases when the pilot signal is not generated anymore, the predetermined area detection signal rises to indicate the outside of the predetermined area temporarily (time t22), the pilot signal is again received, the predetermined area detection signal falls with the finish of the toll charging operation with the other vehicle C (time t23) and the process of FIG. 8 is resumed (time t24). Even for this case, similar to the case when there is noise, because the communication prohibition time has not yet lapsed, step 230 gives a negative output and step 270 immediately makes the CPU 30 enter the sleep state.

This does not only apply to the case when the roadside device 2 has commenced communication with another vehicle C, but, as shown in FIGS. 9F–9J, also applies to the case when the pilot signal is not received temporarily due to some cause (time t31) but, in the same way, is received again (time t32), with step 230 giving a negative output because the predetermined time has not yet elapsed and the process of step 270 making the CPU 30 enter the sleep state, thus preventing the execution of double toll charging and enabling the lowering of electric power consumption.

Also, in step 220, a positive output is given when the ID of the roadside device 2 is the same as the previously stored ID, and then, in case the communication prohibition time lapses, a positive decision is made and step 240 executes the toll charging procedure. This is the case when the vehicle V has returned to the same roadside device 2 and so, there is a need to charge toll.

As explained above, in the present embodiment, under the movement conditions wherein the vehicle C is moving fast, by shortening the communication stoppage time, the controller 10 can prevent the vehicle-mounted device 4, which has been set with the communication stoppage time after receiving such communication stoppage time data, from leaving a predetermined area and entering a different predetermined area or reentering the same predetermined area by returning back without executing the necessary communication (toll charging procedure for toll roads ).

Also, under movement conditions wherein the vehicle C is not moving fast, by extending the communication stoppage time, the controller 10 prevents the same communication from being performed when the vehicle-mounted device 4, which has been set with the communication stoppage time after receiving such communication stoppage time data, is in the same predetermined area and has not yet left the same predetermined area even for once, and thus, there will be no unfavorable result of having repeated communication (double toll charging).

In the present embodiment, the vehicular detector 8 corresponds to the movement condition detection means, step 150 corresponds to the process of the communication prohibition time setting means, step 100 corresponds to the process of the communication stoppage time sending means, vehicle-mounted device 4 corresponds to the mobile communication moving body-mounted device, the roadside device 2 corresponds to the mobile communication roadside device, steps 230 and 270 correspond to the process of the communication prohibition means, step 200 corresponds to the process of the area determination means, steps 220 and 230 correspond to the process of the communication permission means and step 250 corresponds to the process of the area storage means.

Meanwhile, if it is known that the vehicle C will be at a complete stop for a long period of time, the communication of the roadside device 2 side may be terminated.

Also, if it is known that the vehicle will be at a complete stop for a long period of time, after executing the toll charging procedure once, the vehicle-mounted device 4 may also continue the sleep state of the CPU 30 until the vehicle C starts to move.

In the above-described first embodiment, while passing vehicle speed v and vehicle passage count n are computed using the signal from the vehicular detector 8, these detection can also be performed without using the vehicular detector 8 through the receipt of the roadside device 2 of the signal from the vehicle-mounted device 4. Because each vehicle-mounted device 4 has its own ID, based on a time difference (sec.) between time tx1 which is the time of passing a roadside device 2 and time tx2 which is the time of passing another roadside device 2, and a distance H (m) between the two roadside devices 2, speed v can be computed according to the following Eq. 5.

$$v=H/(tx2-tx1) \quad (5)$$

Also, the number of vehicles n that have passed can be obtained when the roadside device 2 counts the number of communications per unit time of measurement.

Moreover, in the above-described embodiment, there is no need to compute the passing speed v itself to obtain the communication stoppage time. The communication stoppage time may be computed using data which reflects passing speed v.

For example, instead of using passing speed v, the data of the time the light beam detected by the vehicular detector 8 is continuously blocked (in other words, the passage time per vehicle) itself may be used in computing the communication stoppage time.

Also, when the predetermined area detection signal of the activation circuit 22 continues to indicate the vehicle is outside the predetermined area signal for no less than a predetermined period of time, it may be judged that the vehicle has left the predetermined area E.

In addition, the process of step 230 of FIG. 8 may be omitted and when a positive decision is given in step 220, control may go immediately to the sleep mode setting process of step 270.

Also, in the above embodiment, while the predetermined area detection signal rises immediately when the pilot signal is not continuously received, by setting a predetermined delay time which is no shorter than the toll charging processing time, the activation circuit 22 can be constructed as hardware so that the predetermined area detection signal is not made to rise if the pilot signal is not received during such predetermined delay time. With this construction, for example, like time t24 of FIGS. 9A–9E and time t32 of FIG. 9F–9J, there will be no need for the CPU 30 to operate for a moment and then to sleep again.

Although the present invention has been fully described in connection with preferred embodiments thereof with reference to the accompanying drawings, it is to be noted that various changes and modifications will become apparent to those skilled in the art. Such changes and modifications are to be understood as being within the scope of the present invention as defined by the appended claims.

What is claimed is:

1. A mobile communication system including a mobile communication roadside device for sending a predetermined signal to a predetermined area along a movement route, as well as for performing a predetermined communication operation with a mobile communication moving body-mounted device which responds to said predetermined signal, wherein said mobile communication roadside device comprises:

movement condition detection means for detecting a movement condition along said movement route;

communication stoppage time setting means for setting a communication stoppage time in accordance with said movement condition detected by said movement condition detection means; and communication stoppage time sending means for sending said communication stoppage time set by said communication stoppage time setting means after including communication stoppage time data indicative of said communication stoppage time in said predetermined signal.

2. A mobile communication system according to claim 1, wherein:

said movement condition detection means detects a movement speed of a moving body along said movement route or data which corresponds to said movement speed as said movement condition; and said communication stoppage time setting means shortens a length of said communication stoppage time when said movement speed becomes faster, and lengthens said length of said communication stoppage time when said movement speed becomes slower in accordance with said movement condition detected by said movement condition detection means.

3. A mobile communication system according to claim 1 wherein:

said moving body is an automobile; and said predetermined communication is a toll charging process.

4. A mobile communication system according to claim 1, wherein said mobile communication moving body-mounted device comprises communication prohibition means for prohibiting another communication with said mobile communication roadside device during a communication stoppage time after performing said predetermined communication operation based on communication stoppage time data included in said predetermined signal.

5. A mobile communication system according to claim 4 wherein said mobile communication moving body-mounted device further comprises:

area determination means for giving a within predetermined area decision when said predetermined signal is received and for giving an outside predetermined area decision when said predetermined signal is not received; and communication permission means for permitting said predetermined communication when moving from outside said predetermined area to inside said predetermined area based on said within predetermined area decision of said area determination means, and said communication prohibition means has not prohibited another communication.

6. A mobile communication system according to claim 5 wherein said mobile communication moving-body mounted device further comprises:

area storage means for storing data indicative of a predetermined area that has been passed previously;

wherein said communication permission means is for permitting said predetermined communication even if said communication prohibition means prohibits another communication if a present predetermined area is different from said previous predetermined area stored by said area storage means when moving from outside said predetermined area to inside said predetermined area based on said within predetermined area decision of said area determination means.

7. A mobile communication system according to claim 4, wherein:

said predetermined communication is executed through a CPU computation process; and said communication prohibition means prohibits another communication by making said CPU enter a sleep state.

* * * * *